US009199887B2

(12) United States Patent
Hafner et al.

(10) Patent No.: US 9,199,887 B2
(45) Date of Patent: Dec. 1, 2015

(54) PROPELLANT COMPOSITIONS INCLUDING STABILIZED RED PHOSPHORUS AND METHODS OF FORMING SAME

(71) Applicant: Orbital ATK, Inc., Dulles, VA (US)

(72) Inventors: Matthew T. Hafner, Blue Springs, MO (US); Ruben Balangue, Holland, MI (US); Danny D. Clark, Blue Springs, MO (US); John William Westbrook, III, Lees Summit, MO (US)

(73) Assignee: Orbital ATK, Inc., Dulles, VA (US)

( * ) Notice: Subject to any disclaimer, the term of this patent is extended or adjusted under 35 U.S.C. 154(b) by 0 days.

(21) Appl. No.: 14/166,521

(22) Filed: Jan. 28, 2014

(65) Prior Publication Data

US 2014/0137996 A1 May 22, 2014

Related U.S. Application Data

(62) Division of application No. 13/222,751, filed on Aug. 31, 2011, now Pat. No. 8,641,842.

(51) Int. Cl.

| | |
|---|---|
| ***C06B 45/32*** | (2006.01) |
| ***C06B 39/00*** | (2006.01) |
| ***C06B 25/28*** | (2006.01) |
| ***C06B 25/30*** | (2006.01) |
| ***D03D 23/00*** | (2006.01) |
| ***D03D 43/00*** | (2006.01) |
| ***C06B 45/30*** | (2006.01) |

(Continued)

(52) U.S. Cl.

CPC ..... *C06B 45/30* (2013.01); *C06B 25/24* (2013.01); *C06B 39/00* (2013.01); *C06B 45/105* (2013.01)

(58) Field of Classification Search

USPC ..... 149/6, 29, 94, 95, 109.4

See application file for complete search history.

(56) References Cited

U.S. PATENT DOCUMENTS

| | | | |
|---|---|---|---|
| 998,007 | A | 7/1911 | Imperiali |
| 2,194,480 | A | 3/1940 | Pritham et al. |

(Continued)

FOREIGN PATENT DOCUMENTS

| | | |
|---|---|---|
| DE | 10138745 A1 | 9/2010 |
| EP | 0070932 | 2/1983 |

(Continued)

OTHER PUBLICATIONS

Alenfelt, Corrosion Protection of Magnesium Without the Use of Chromates, Pyrotechnica XVI (Aug. 1995) pp. 44-49, Pyrotechnica Pulbications, Austin TX.

(Continued)

*Primary Examiner* — James McDonough

(74) *Attorney, Agent, or Firm* — TraskBritt

(57) ABSTRACT

Propellant compositions include an energetic binder, such as nitrocellulose, and a stabilized, encapsulated red phosphorous as a ballistic modifier. The propellant composition may additionally include an energetic plasticizer, such as nitroglycerine. For example, the propellant composition may be formed by mixing a double or multi base propellant that includes nitrocellulose plasticized with nitroglycerine with the stabilized, encapsulated red phosphorus. The propellant compositions may be substantially lead-free and may exhibit improved ballistic properties. Methods of forming such propellant compositions and an ordnance device including such propellant compositions are also disclosed.

11 Claims, 8 Drawing Sheets

(51) Int. Cl.
*C06B 25/24* (2006.01)
*C06B 45/10* (2006.01)

(56) References Cited

U.S. PATENT DOCUMENTS

| | | | | |
|---|---|---|---|---|
| 2,206,048 | A | | 7/1940 | Rechel et al. |
| 2,231,946 | A | | 2/1941 | Rechel et al. |
| 2,349,048 | A | | 5/1944 | Mackey et al. |
| 2,420,651 | A | | 5/1947 | Burrows et al. |
| 2,649,047 | A | | 8/1953 | Silverstein |
| 2,664,344 | A | | 12/1953 | Nordblom et al. |
| 2,929,699 | A | | 3/1960 | Audrieth et al. |
| 2,970,900 | A | | 2/1961 | Woodring et al. |
| 3,026,221 | A | | 3/1962 | Kirst et al. |
| 3,113,059 | A | | 12/1963 | Ursenbach et al. |
| 3,181,463 | A | | 5/1965 | Morgan et al. |
| 3,187,671 | A | | 6/1965 | Quinlan et al. |
| 3,275,484 | A | | 9/1966 | Foote |
| 3,367,805 | A | | 2/1968 | Clay et al. |
| 3,420,137 | A | | 1/1969 | Stabba |
| 3,437,534 | A | | 4/1969 | McEwan et al. |
| 3,488,711 | A | | 1/1970 | Dany et al. |
| 3,540,819 | A | | 11/1970 | Shaffer et al. |
| 3,634,153 | A | | 1/1972 | Perkins et al. |
| 3,650,856 | A | | 3/1972 | Artz |
| 3,707,411 | A | | 12/1972 | Furth et al. |
| 3,726,217 | A | | 4/1973 | Dedman et al. |
| 3,755,019 | A | | 8/1973 | Huskins et al. |
| 3,767,488 | A | | 10/1973 | Seals |
| 3,834,956 | A | | 9/1974 | Mellow et al. |
| 3,904,451 | A | | 9/1975 | Rainone et al. |
| 4,014,719 | A | | 3/1977 | Wells |
| 4,059,388 | A | | 11/1977 | Shaffer |
| 4,133,707 | A | | 1/1979 | Andrew |
| 4,142,927 | A | | 3/1979 | Walker |
| 4,145,969 | A | | 3/1979 | Gawlick et al. |
| 4,196,026 | A | | 4/1980 | Walker |
| 4,226,792 | A | | 10/1980 | Tajima |
| 4,304,614 | A | | 12/1981 | Walker et al. |
| 4,315,897 | A | | 2/1982 | Staendeke et al. |
| 4,336,085 | A | | 6/1982 | Walker |
| 4,428,292 | A | | 1/1984 | Riggs |
| 4,522,665 | A | | 6/1985 | Yates, Jr. et al. |
| 4,554,031 | A | | 11/1985 | Kerviel et al. |
| 4,581,082 | A | | 4/1986 | Hagel |
| 4,698,215 | A | | 10/1987 | Albanesi |
| 4,728,375 | A | | 3/1988 | Simpson |
| 4,853,288 | A | | 8/1989 | Staendeke et al. |
| 4,963,201 | A | | 10/1990 | Bjerke et al. |
| 4,976,793 | A | | 12/1990 | Zimmermann |
| 5,027,707 | A | | 7/1991 | Mei |
| 5,167,736 | A | | 12/1992 | Mei |
| 5,208,420 | A | | 5/1993 | Hamilton et al. |
| 5,216,199 | A | | 6/1993 | Bjerke et al. |
| 5,316,600 | A | | 5/1994 | Chan et al. |
| 5,388,519 | A | | 2/1995 | Guindon |
| 5,417,160 | A | | 5/1995 | Mei et al. |
| 5,449,423 | A | | 9/1995 | Cioffe |
| 5,466,315 | A | | 11/1995 | Erickson et al. |
| 5,522,320 | A | | 6/1996 | Dillehay |
| 5,547,528 | A | * | 8/1996 | Erickson et al. ..... 149/92 |
| 5,557,061 | A | | 9/1996 | Ramaswamy |
| 5,567,252 | A | | 10/1996 | Mei |
| 5,569,875 | A | | 10/1996 | Fey |
| 5,610,367 | A | | 3/1997 | Erickson et al. |
| 5,672,219 | A | | 9/1997 | Rinaldi et al. |
| 5,684,268 | A | | 11/1997 | Lopata |
| 5,717,159 | A | | 2/1998 | Dixon et al. |
| 5,780,768 | A | | 7/1998 | Knowlton et al. |
| 5,831,208 | A | | 11/1998 | Erickson |
| 5,939,661 | A | | 8/1999 | Bayliss |
| 5,992,327 | A | | 11/1999 | Wardecki et al. |
| 6,053,108 | A | | 4/2000 | Remerowski |
| 6,057,264 | A | | 5/2000 | Bradbury |
| 6,066,214 | A | | 5/2000 | Comfort |
| 6,165,294 | A | | 12/2000 | Fogelzang et al. |
| 6,322,648 | B2 | | 11/2001 | Rayer et al. |
| 6,425,966 | B1 | | 7/2002 | Highsmith et al. |
| 6,478,903 | B1 | | 11/2002 | John, Jr. et al. |
| 6,544,363 | B1 | | 4/2003 | Erickson |
| 6,581,520 | B1 | | 6/2003 | Koch |
| 6,588,344 | B2 | | 7/2003 | Clark et al. |
| 6,612,242 | B2 | | 9/2003 | Raupp et al. |
| 6,620,267 | B1 | | 9/2003 | Guindon et al. |
| 6,641,683 | B1 | | 11/2003 | McKenney, Jr. et al. |
| 6,645,625 | B2 | | 11/2003 | Hörold et al. |
| 6,663,731 | B1 | | 12/2003 | Rose et al. |
| 6,782,827 | B2 | | 8/2004 | Miskelly, Jr. |
| 6,878,221 | B1 | | 4/2005 | Mei |
| 7,129,348 | B1 | | 10/2006 | Wardle et al. |
| 7,192,649 | B1 | | 3/2007 | Jouet et al. |
| 7,670,446 | B2 | | 3/2010 | Puszynski et al. |
| 7,857,921 | B2 | * | 12/2010 | Busky et al. ..... 149/30 |
| 8,192,568 | B2 | | 6/2012 | Erickson et al. |
| 8,202,377 | B2 | | 6/2012 | Erickson et al. |
| 8,206,522 | B2 | | 6/2012 | Sandstrom et al. |
| 8,282,751 | B2 | | 10/2012 | Johnston et al. |
| 8,524,018 | B2 | | 9/2013 | Busky et al. |
| 8,540,828 | B2 | | 9/2013 | Busky et al. |
| 2002/0007885 | A1 | | 1/2002 | Serizawa et al. |
| 2002/0127403 | A1 | | 9/2002 | Horold |
| 2002/0129724 | A1 | | 9/2002 | Clark |
| 2005/0183805 | A1 | | 8/2005 | Pile et al. |
| 2005/0189053 | A1 | | 9/2005 | Pile et al. |
| 2005/0224147 | A1 | | 10/2005 | Jung et al. |
| 2006/0060273 | A1 | | 3/2006 | Smith |
| 2006/0113014 | A1 | | 6/2006 | Puszynski et al. |
| 2006/0219341 | A1 | | 10/2006 | Johnston et al. |
| 2006/0272756 | A1 | | 12/2006 | Kneisl |
| 2007/0017612 | A1 | | 1/2007 | Hagel et al. |
| 2007/0102076 | A1 | | 5/2007 | Redecker et al. |
| 2008/0110365 | A1 | | 5/2008 | Rastegar et al. |
| 2008/0245252 | A1 | | 10/2008 | Erickson et al. |
| 2009/0139618 | A1 | | 6/2009 | Petrie et al. |
| 2010/0032063 | A1 | * | 2/2010 | Mei et al. ..... 149/22 |
| 2010/0116385 | A1 | | 5/2010 | Johnston et al. |
| 2011/0000390 | A1 | | 1/2011 | Erickson et al. |
| 2011/0239887 | A1 | | 10/2011 | Sandstrom et al. |
| 2013/0048163 | A1 | | 2/2013 | Hafner et al. |

FOREIGN PATENT DOCUMENTS

| | | | |
|---|---|---|---|
| EP | 0283759 | B1 | 7/1990 |
| EP | 0334725 | B1 | 2/1993 |
| EP | 0560583 | | 9/1993 |
| EP | 0699646 | B1 | 3/1996 |
| EP | 0952130 | A1 | 10/1999 |
| EP | 1195366 | A3 | 7/2003 |
| EP | 1443034 | A2 | 8/2004 |
| EP | 0737174 | B1 | 9/2004 |
| EP | 1195366 | A3 | 1/2006 |
| WO | 9515298 | A1 | 6/1995 |
| WO | 9612770 | A1 | 5/1996 |
| WO | 9944968 | A1 | 9/1999 |
| WO | 0121558 | A1 | 3/2001 |
| WO | 0206421 | A1 | 1/2002 |
| WO | 2006009579 | A2 | 1/2006 |
| WO | 2006009579 | A3 | 1/2006 |
| WO | 2006083379 | A2 | 8/2006 |
| WO | 2008100252 | | 8/2008 |
| WO | 2009079788 | A1 | 7/2009 |
| WO | 2009102338 | | 8/2009 |
| WO | 2011123437 | | 10/2011 |

OTHER PUBLICATIONS

Busky, Randall, et al., "Non-toxic Heavy Metal Free Primers for Small Arms Cartridges—Red Phosphorous Based," presented May 8, 2007.

Collins, et al; "The Use of Red Phosphorous in Pyrotechnics—Results of an International Investigation"; 31st International Pyrotechnic Seminar Proceedings, Jul. 2004, Colorado Springs, Colorado, Copyright © 2002, IPSUSA.

(56) References Cited

OTHER PUBLICATIONS

Definition of "composition," Hackh's Chemical Dictionary, 4th Ed., Copyright 1969 by McGraw-Hill, Inc., New York, NY.
Definition of "mixture," The American Heritage College Dictionary, 3rd Ed., Copyright 2000 by Houghton Mifflin Company, Boston, MA.
Eisentrager, Frank; "Key Parameters for the Stability of Red Phosphorous"; 31st International Pyrotechnic Seminar Proceedings, Jul. 2004, Colorado Springs, Colorado, Copyright 2000 © IPSUSA.
European Search Report for European Application No. EP 07 00 4155, dated Jul. 16, 2007.
Hoerold et al., Commercial Developments in Red Phosphorous Performance and Stablity for Pyrotechnics; Journal of Pyrotechnics, Issue 12, Summer 2001 Copyright © 2001 IPS.
Horold, Sebastian; "Improvements in Stability of Red Phosphorous", 27th International Pyrotechnic Seminar Proceedings, Jul. 2000, Grand Junction Colorado, Copyright © 2000 IPSUSA.
Levitas, Valery I., et al., "Mechanochemical mechanism for fast reaction of metastable intermolecular composites based on dispersion of liquid metal," J. Appl. Phys., vol. 101, pp. 083524-1 through 083524-20, 2007.
Muller, Citric Acid as Corrosion Inhibitor for Aluminium Pigment, Corrosion Science, Abstract, vol. 46, No. 1, Jan. 2004, pp. 159-167.
Nordblom, et al., Frankfort Arsenal Report No. R-206; The Stabilization of Commercial Red Phosphorus Final Report, Research Item No. 202.14, Frankford Arsenal Library, Apr. 1943.
Ostrowski et al., AL/Mo03 MIC Primer Evaluation Tests Part II: Delay Cartridges, American Institute of Aeronautics and Astronautics, AIAA/ASME/SAE/ASEE Joint Propulsion Conference, Huntsville, AAL. 2000 Paper 2000-3647.
Ostrowski et al., Nano Energetics for US Navy Percussion Primer Applications, Energetic Materials Technology, 2006, pp. 1-6.
Ostrowski et al., Recent Accomplishments in MIC Primer Development at NSWC/Indian Head, Paper 2005-3514, AIAA 41st Joint Propulsion Conference, Tucson, AZ, 2005.
Provatas, Arthur, Energetic Polymers and Plasticisers for Explosive Formulations—A review of Recent Advances, Weapons Systems Division Aeronautical and Maritime Research Laboratory, Apr. 2000, 44 pages.
Railsback, L. Bruce, "An earth scientist's periodic table of the elements and their ions," Geology, pp. 737-740, Sep. 2003.
Railsback, L. Bruce, "An earth scientist's periodic table of the elements and their ions," Version 4.8, University of Georgia, Athens, Georgia, © 2007, http://www.gly.uga.edu/railsback/PT.html.
Ratcliff, Andrew; "Review of Six Generations of Red Phosphorous 1950-1999 and Beyond", 27th International Pyrotechnic Seminar Proceedings, Jul. 2000, Grand Junction Colorado, Copyright 2000 © IPSUSA.
Rovner, Sophie, "How a Lubricant Additive Works," Chemical & Engineering News, vol. 83, No. 11, p. 10, © 2005.
Stevenson, et al., Frankford Arsenal Report No. R-265; Caliber .30 Red Phosphorus Primers, Third Report Research Item No. 204.0, Frankfort Arsenal Library, Feb. 1943.
United States Army, Small Caliber Ammunition Test Procedures 5.56mm Cartridges, Picatinny Aresenal, New Jersey, Nov. 1998, pp. 1-191.
International Search Report, Application No. PCT/US2012/047181, issued by the ISA/EP on Jan. 31, 2013, four (4) pages.
International Written Opinion of the International Search Authority, Application No. PCT/US2012/047181, issued by the ISA/EP on Jan. 31, 2013, four (4) pages.
Ministry of Manpower, "Safe Use, Handling and Storage of Nitrocellulose," Occupational Safety & Health Circular, http://safety.com.sg/pds/files/pdf/Safe%20Use%20&%20Handling%20&%20Storage%20of%20Nitrocellulose.pdf, accessed Mar. 9, 2015, 4 pages.

* cited by examiner

PROPELLANT COMPOSITIONS INCLUDING STABILIZED RED PHOSPHORUS AND METHODS OF FORMING SAME

CROSS-REFERENCE TO RELATED APPLICATIONS

This application is a divisional of U.S. patent application Ser. No. 13/222,751, filed Aug. 31, 2011, now U.S. Pat. No. 8,641,842, issued Feb. 4, 2014, which is related to U.S. patent application Ser. No. 11/367,000, filed Mar. 2, 2006, now U.S. Pat. No. 7,857,921, issued Dec. 28, 2010; to U.S. patent application Ser. No. 12/978,080, Filed Dec. 23, 2010, now U.S. Pat. No. 8,524,018, issued Sep. 3, 2013, entitled "Percussion Primers Comprising a Primer Composition and Ordnance Including the Same;" and to U.S. patent application Ser. No. 12/194,437, filed Aug. 19, 2008, now U.S. Pat. No. 8,540,828, issued Sep. 24, 2013, and entitled "Nontoxic, Noncorrosive Phosphorus-Based Primer Compositions and an Ordnance Element Including the Same."

TECHNICAL FIELD

The present disclosure relates to propellant compositions including a stabilized, encapsulated red phosphorus. More specifically, the present disclosure relates to propellant compositions that include the stabilized, encapsulated red phosphorus and at least one energetic binder, a method of forming such propellant compositions and an ordnance element including such propellant compositions.

BACKGROUND

Propellants including two base components, such as a nitrocellulose (NC) and an energetic plasticizer, are commonly referred to as so-called "double base" propellants and are widely used in munitions, such as rifle and pistol cartridges, rocket motors, mortar shells, shotgun shells and missiles. Examples of energetic plasticizers that may be combined with the nitrocellulose to form the double base propellant include, but are not limited to, nitroglycerine, butanetriol trinitrate and diglycol dinitrate. The nitrocellulose desensitizes the highly unstable energetic plasticizer, preventing the double base propellant from detonating as a high explosive. The energetic plasticizer gelatinizes the nitrocellulose, increasing the energy density of the double base propellant. For example, conventional double base propellants may include, as main ingredients, between about 10% by weight (wt %) and about 90 wt % nitrocellulose and between about 10 wt % and about 90 wt % nitroglycerine. Such double base propellants may be loaded within a cartridge or shell casing used in an ordnance element, along with a primer composition used to initiate or ignite the double base propellant. The double base propellants may also be used in rocket motors and missiles, where they are disposed inside a case to provide thrust upon burning.

For ballistic applications, it is desirable for propellants to burn at a controlled and predictable rate without performance loss. Controlling the ballistic properties of the propellant, such as burn rate, enables proper function of the ordnance element or rocket motor. When the burn rate of the propellant is too high, pressures within the cartridge, shell casing or rocket motor case may exceed design capability, resulting in damage to or destruction of the cartridge, shell casing or rocket motor case. On the other hand, if the burn rate of the propellant is too low, the propellant may not provide sufficient velocity to propel a projectile of the ordnance element or the rocket motor over a desired course.

To tailor the ballistic properties of the propellant, such as the burn rate and the velocity, materials that control ballistic properties, so-called "ballistic modifiers," may be included in the propellant. Various organometallic salts and various oxides have been used to modify the ballistic properties of propellants, such as double base propellants. Examples of such ballistic modifiers include lead-based compounds, such as, lead salts and lead oxides (e.g., lead salicylate, lead β-resorcylate and lead stearate). The use of lead-based compounds as ballistic modifiers poses a concern for the environment and for personal safety due to the toxic nature of lead when introduced into the atmosphere by propellant manufacture, rocket motor firing and disposal. The presence of these lead-based ballistic modifiers is, therefore, detrimental to the environment when the propellant is burning.

Conventional propellants may also contain ammonium perchlorate (AP), which upon combustion produces the toxic substance hydrochloric acid (HCl). Chloride ions released from hydrochloric acid in the upper atmosphere may react with and destroy ozone.

Other, nontoxic compounds have been investigated as potential replacements for lead-based ballistic modifiers in propellants. For example, copper- and barium-based compounds have been shown to modify the ballistic properties of propellants. However, performance characteristics of the propellants are impaired by the use of these copper- and barium-based compounds. Solid propellants containing copper salts as the ballistic modifier may exhibit a poor aging. Barium salts, being highly soluble in water, are problematic in conventional manufacturing processes used to form the propellants.

Red phosphorus has been investigated as a component in primer compositions for military applications. Red phosphorus is an allotrope of phosphorus that has a network of tetrahedrally arranged groups of four phosphorus atoms linked into chains. White phosphorous is another allotrope that is much more reactive and toxic than red phosphorus. The two allotropes have such unique physical characteristics that they have different CAS numbers, as registered by the Chemical Abstract Service ("CAS"). Red phosphorus is relatively stable in air and is easier to handle than other allotropes of phosphorus. However, if red phosphorus is exposed to oxygen ($O_2$), water ($H_2O$), or mixtures thereof at elevated temperatures, such as during storage, the red phosphorus reacts with the oxygen and water, releasing phosphine ($PH_3$) gas and phosphoric acids ($H_3PO_2$, $H_3PO_3$, or $H_3PO_4$). As is well known, the phosphine is toxic and the phosphoric acids are corrosive. To improve the stability of red phosphorus in environments rich in oxygen or water, dust suppressing agents, stabilizers, or microencapsulating resins have been used. The dust suppressing agents are liquid organic compounds. The stabilizers are typically inorganic salts, such as metal oxides. The microencapsulating resins are thermoset resins, such as epoxy resins or phenolic resins. Currently, microencapsulating resins are not used in military applications. The military specification for phosphorous has been deactivated and is not expected to be updated to include encapsulation.

U.S. Pat. No. 7,857,921 to Busky et al. discloses a primer composition that includes a stabilized, encapsulated red phosphorus and combinations of at least one oxidizer, at least one secondary explosive composition, at least one light metal, or at least one acid resistant binder. The stabilized, encapsulated red phosphorus may include particles of red phosphorus, a metal oxide coating, and a polymer layer.

BRIEF SUMMARY

In some embodiments, the present disclosure includes propellant compositions. For example, such a propellant composition may include nitrocellulose and a stabilized, encapsulated red phosphorous.

In another embodiment, the propellant compositions of the present disclosure may include a propellant comprising an energetic binder and an energetic plasticizer and a stabilized, encapsulated red phosphorus.

In yet another embodiment, the present disclosure includes an ordnance element. The ordnance element may include a propellant composition comprising a stabilized, encapsulated red phosphorus and an energetic binder comprising nitrocellulose and at least one of another explosive and a primer.

In a further embodiment, the present disclosure includes a method of forming a propellant composition. Such a method may include combining a stabilized, encapsulated red phosphorus with a propellant comprising nitrocellulose and an energetic plasticizer.

DETAILED DESCRIPTION

Figure 1:
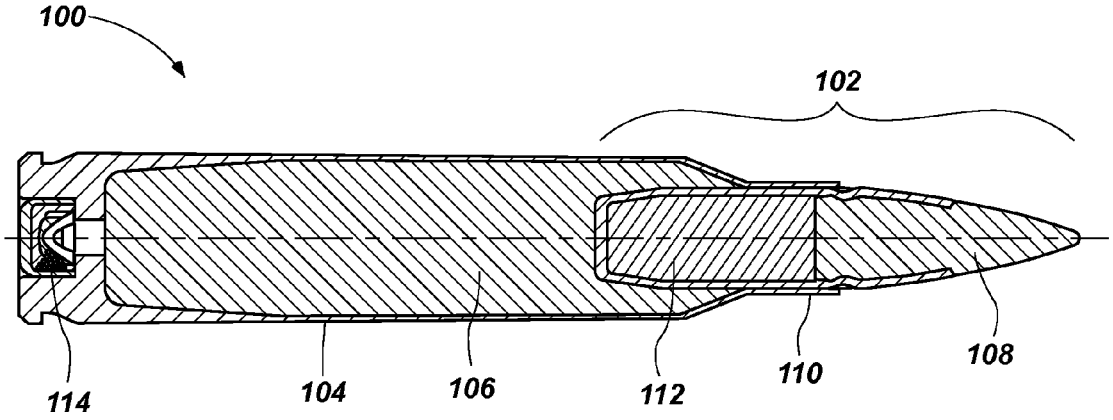
FIG. 1 is a cross-sectional view of a ordnance cartridge including an embodiment of the propellant composition of the present disclosure.

Propellant compositions that include at least one energetic binder combined with encapsulated, stabilized red phosphorus are disclosed. The propellant compositions may be used in an ordnance element or a weapon system, such as, a cartridge, a shotgun shell, an artillery shell, a rocket motor, or a missile, for example. Upon combustion, the propellant compositions of the present disclosure may exhibit a reduced peak pressure in comparison to conventional propellants while an average pressure of the propellant compositions of the present disclosure is maintained or improved. Thus, the propellant compositions may provide a desirable reduction in mechanical stress on the ordnance element or weapon system while maintaining velocity. Addition of the stabilized, encapsulated red phosphorus may modify the ballistic properties of the propellant compositions, reducing or eliminating the need for conventional (e.g., lead-based) ballistic modifiers. The propellant compositions may, thus, be substantially lead-free, reducing or eliminating environmental issues associated with lead-based compositions. The propellant compositions may include ingredients that are low in toxicity (e.g., green), free of heavy metals, stable to aging and noncorrosive. These ingredients may include elements that are biologically available, have a high concentration tolerance, and are active in known cycles in the environment or biosphere. When combusted, the propellant compositions may generate nontoxic and noncorrosive combustion products and byproducts. By using encapsulated, stabilized red phosphorus in the propellant compositions, a decreased amount of the propellant composition of the present disclosure may be used in the ordnance element relative to the amount of conventional propellant used in the ordnance element to achieve a desired velocity of the ordnance element. Or, an increase in velocity performance of the ordnance element may be achieved using the same amount of the propellant composition of the present disclosure relative to the amount of conventional propellant.

As used herein, the term "burn rate" means and includes a rate at which a propellant composition releases energy during combustion.

As used herein, the term "peak pressure" means and includes the force exerted by a burning propellant within a chamber, such as within a rocket motor case.

As used herein, the term "single base propellant" means and includes a composition that includes an energetic binder, such as nitrocellulose (NC), and at least one additive, such as, a plasticizer, a ballistic modifier, a stabilizer, a flash suppressor, etc.

As used herein, the term "double base propellant" means and includes a composition that includes at least one energetic binder, such as nitrocellulose, and at least one energetic plasticizer, such as a nitrate ester. For example, the double base propellant may include nitrocellulose plasticized with the nitrate ester nitroglycerine (NG).

As used herein, the term "multi base propellant" means and includes a propellant that includes at least one energetic binder, such as nitrocellulose, at least one energetic plasticizer, and an energetic fuel other than nitrocellulose, such as, nitroguanidine.

A propellant composition of the present disclosure may include an energetic binder and a stabilized, encapsulated form of red phosphorus. As used herein, the term "stabilized, encapsulated" refers to red phosphorus having improved stability to oxidation relative to red phosphorus that lacks stabilization and encapsulation. For instance, when the stabilized, encapsulated red phosphorus is exposed to an environment that includes oxygen ($O_2$), water ($H_2O$), or mixtures thereof, the stabilized, encapsulated red phosphorus does not readily react with the oxygen or water, in contrast to red phosphorus that lacks stabilization. The stabilized, encapsulated red phosphorus may have an increased useful lifetime in the propellant composition compared to red phosphorus that lacks stabilization. The stabilized, encapsulated red phosphorus may account for up to about 10 wt % of a total weight of the propellant composition, more particularly, between about 0.1 wt % of the total weight of the propellant composition and about 5 wt % of the total weight of the propellant composition.

The red phosphorus may be stabilized by coating the red phosphorus with a metal oxide, such as a metal hydroxide, such as by coating particles of the red phosphorus. The metal oxide may be precipitated on a surface of the red phosphorus. The metal oxide coating functions as a stabilizer to buffer traces of acids that form upon oxidation of the red phosphorus. The metal oxide may be aluminum hydroxide, bismuth hydroxide, cadmium hydroxide, cerium hydroxide, chromium hydroxide, germanium hydroxide, magnesium hydroxide, manganese hydroxide, niobium hydroxide, silicon hydroxide, tin hydroxide, titanium hydroxide, zinc hydroxide, zirconium hydroxide, or mixtures thereof. The metal oxide may be present in the stabilized, encapsulated red phosphorus in a total quantity of between about 0.1 wt % and about 5 wt % and, more particularly, about 2 wt %, based on the quantity of red phosphorus.

Once stabilized, the red phosphorus may be encapsulated by coating the red phosphorus with a polymer, such as a thermoset resin. Encapsulating particles of the stabilized, red phosphorus reduces their active surface and provides the stabilized, red phosphorus with water repellency and acid resistance. Examples of polymers that may be used to encapsulate the stabilized, red phosphorus include, but are not limited to, an epoxy resin, melamine resin, phenol formaldehyde resin, polyurethane resin, or mixtures thereof. The polymer may be present in the stabilized, encapsulated red phosphorus in a total quantity of between about 1 wt % and about 5 wt % based on the quantity of red phosphorus. The metal oxide and the polymer may be present in a total quantity of between about 1.1% wt % and about 8 wt % based on the quantity of red phosphorus.

The red phosphorus may be coated with the metal oxide by mixing an aqueous suspension of the particles of the red phosphorus with a water-soluble metal salt. The pH of the aqueous suspension may be adjusted, precipitating the metal oxide on the red phosphorus. An aqueous solution of a preliminary condensation product of the polymer may be prepared and added, with mixing, to the coated red phosphorus. The solution and the coated red phosphorus may be reacted for a period of time that ranges from approximately 0.5 hour to approximately 3 hours at a temperature ranging from approximately 40° C. to approximately 100° C., enabling the preliminary condensation product to polymerize and harden around the coated red phosphorus. The particles of the stabilized, encapsulated red phosphorus may then be filtered and dried at an elevated temperature, such as at a temperature ranging from approximately 80° C. to approximately 120° C., in a stream of nitrogen. Stabilized, encapsulated red phosphorus is commercially available, such as from Clariant GmbH (Frankfurt, Germany). In one embodiment, the stabilized, encapsulated red phosphorus is Red Phosphorus HB 801 (TP), which is available from Clariant GmbH.

The at least one energetic binder used to form the propellant composition may include, for example, nitrocellulose (e.g., plastisol nitrocellulose), cyclodextrin nitrate (CDN), polyvinyl nitrate (PVN), dinitropropylacrylate polymers, polymeric nitroethylenes, and mixtures and combinations thereof. Relative amounts of the stabilized, encapsulated form of red phosphorus and the energetic binder may be adjusted to achieve desired properties of the propellant composition upon combustion.

The propellant composition may further include at least one energetic plasticizer, such as at least one nitrate ester. Examples of such energetic plasticizers include, but are not limited to, nitroglycerine, trinitroglycerine (TNG), metriol trinitrate (MTN), trimethylolethane trinitrate (TMETN), diglycol dinitrate, triethylene glycol dinitrate (TEGDN), butanetriol trinitrate (BTTN), diethyleneglycol dinitrate (DEGDN), propylene glycol dinitrate (PGDN), ethylene glycol dinitrate (EGDN), butyl-2-nitratoethyl-nitramine, methyl-2-nitratoethyl-nitramine and ethyl-2-nitratoethyl-nitramine. The energetic binder may be plasticized with the energetic plasticizer, increasing the energy density of the propellant composition.

By way of example and not limitation, the energetic binder may be present in an amount of between about 10 wt % of the total weight of the propellant composition and about 90 wt % of the total weight of the propellant composition and the energetic plasticizer may be present in an amount of between about 10 wt % of the total weight of the propellant composition and about 90 wt % of the total weight of the propellant composition. The propellant composition may optionally include at least one additive, such as, processing agents and chemical modifiers.

For example, the propellant composition may optionally include at least one inert liquid. Examples of such inert liquids include, but are not limited to, alkyl acetates, phthalates (e.g., dibutyl phthalate, diisoamyl phthalate, diethyl phthalate, dioctylphthalate, dipropylphthalate and dimethyl phthalate), adipates (e.g., polyester adipate, di-2-ethyl hexyl adipate, di-n-propyl adipate and diisooctyl adipate), triacetin, citric acid esters, phosphoric acid esters and urethane. For example, the at least one inert liquid may be present in an amount of between about 0 wt % of the total weight of the propellant composition and about 20 wt % of the total weight of the propellant composition. As a non-limiting example, the propellant composition may include between about 0 wt % and about 10 wt % of each of dibutyl phthalate and polyester adipate as inert liquids.

The propellant composition may optionally include at least one carbon compound, such as graphite, carbon fibers and/or carbon black. As a non-limiting example, the carbon black may be a high surface area carbon black having a surface area of greater than or equal to about 25 $m^2/g$. For example, the least one carbon compound may be present in an amount of between about 0 wt % of the total weight of the propellant composition and about 5 wt % of the total weight of the propellant composition. As a non-limiting example, between about 0.02 wt % of the total weight of the propellant composition and about 1 wt % of the total weight of the propellant composition may include graphite as the at least one carbon compound.

The propellant composition may optionally include at least one solvent. Examples of such solvents include, but are not limited to, acetone, dinitrotoluene, methyl ethyl ketone, ethyl acetate, butyl acetate, propyl acetate, methyl t-butyl ether, methyl t-amyl ether and tetrahydrofuran. For example, at least one solvent may be present in an amount of between about 0 wt % of the total weight of the propellant composition and about 5 wt % of the total weight of the propellant composition. As a non-limiting example, between about 0 wt % of the total weight of the propellant composition and about 1 wt % of the total weight of the propellant composition may include ethyl acetate as the at least one solvent.

The propellant composition may optionally include at least one stabilizer. Examples of such stabilizers include, but are not limited to, 1,3-diethyl-1,3-diphenylurea (so-called "ethyl centralite" or "carbamite"), diphenylamine, N-nitrosodiphenylamine, carbonates (e.g., calcium carbonate), N-methyl-p-nitroaniline (MNA) and combinations thereof. For example, the at least one stabilizer may be present in an amount of between about 0 wt % of the total weight of the propellant composition and about 15 wt % of the total weight of the propellant composition. As a non-limiting example, between about 0 wt % of the total weight of the propellant composition and about 10 wt % of the total weight of the propellant composition may include 1,3-diethyl-1,3-diphenylurea, between about 0.3 wt % of the total weight of the propellant composition and about 1.5 wt % of the total weight of the propellant composition may include diphenylamine, between about 1 wt % of the total weight of the propellant composition and about 1.5 wt % of the total weight of the propellant composition may include N-nitrosodiphenylamine and between about 0 wt % of the total weight of the propellant composition and about 1 wt % of the total weight of the propellant composition may comprise calcium carbonate.

The propellant composition may optionally include at least one surfactant, such as rosin. For example, the at least one surfactant may be present in an amount of between about 0 wt % of the total weight of the propellant composition and about 5 wt % of the total weight of the propellant composition.

The propellant composition may optionally include at least one oxidizer. Examples of such oxidizers include, but are not limited to, nitrate compounds (e.g., potassium nitrate, lithium nitrate, beryllium nitrate, sodium nitrate, magnesium nitrate, calcium nitrate, rubidium nitrate, strontium nitrate and cesium nitrate), ammonium perchlorate (AP), ammonium nitrate (AN), hydroxylammonium nitrate (HAN), ammonium dinitramide (AND), potassium dinitramide (KDN), potassium perchlorate (KP), and combinations thereof. The at least one oxidizer may be present as a powder or in a particulate form. For example, the at least one oxidizer may be present in an amount of between about 0 wt % of the total weight of the propellant composition and about 50 wt % of the total weight of the propellant composition. As a non-limiting example, the propellant composition may include between about 0 wt % and about 1.5 wt % of the potassium nitrate as the at least one oxidizer.

The propellant composition may optionally include at least one flash suppressor, such as potassium sulfate. As a non-limiting example, between about 0 wt % of the total weight of the propellant composition and about 1.5 wt % of the total weight of the propellant composition may include potassium sulfate as the at least one flash suppressor.

The propellant composition may optionally include at least one inorganic fuel, such as a metal or metal oxide compound. Examples of such inorganic fuels include, but are not limited to, tin, iron, aluminum, copper, boron, magnesium, manganese, silicon, titanium, cobalt, zirconium, hafnium, tungsten, chromium, vanadium, nickel, oxides of iron (e.g., $Fe_2O_3$, $Fe_3O_4$, etc.), aluminum oxide ($Al_2O_3$), magnesium oxide (MgO), titanium oxide ($TiO_2$), copper oxide (CuO), boron oxide ($B_2O_3$), silicon dioxide ($SiO_2$), and manganese oxides (e.g., MnO, $MnO_2$, etc.). The inorganic fuels may be present as a powder or as a particulate material. For example, the at least one inorganic fuel may be present in an amount of between about 0 wt % of the total weight of the propellant composition and about 50 wt % of the total weight of the propellant composition. As a non-limiting example, between about 0 wt % of the total weight of the propellant composition and about 1.5 wt % of the total weight of the propellant composition may include tin oxide as the at least one inorganic fuel.

Thus, the propellant composition may optionally include at least one of an inert liquid, an oxidizer, a flash suppressor, a metal fuel, a carbon compound, a solvent, a stabilizer, a surfactant and an inorganic fuel.

For example, the stabilized, encapsulated red phosphorus may be used to modify a conventional single base, double base or multi base propellant that includes the at least one energetic binder, such as nitrocellulose.

As a non-limiting example, the propellant composition may be formed by mixing or otherwise combining the stabilized, encapsulated red phosphorous with a single base propellant that includes nitrocellulose. The single base propellant may be, for example, an IMR® powder (e.g., IMR 3031™, IMR 4007SSC™, IMR 4064®, IMR 4198™, IMR 4227™, IMR 4320 ™, IMR 4350™, IMR 4576™, IMR 4759™, IMR 4831™, IMR 4895™, SR7625™ IMR 7828™, PB™ and IMR 7828SSC™), or a conventional smokeless powder (e.g., H4227®, H4895®, H4198®, VARGET®, H4350®, H50MBG®, H4831®, H4831SC®, H1000®, RETUMBO®, H322® and BENCHMARK®), each of which is commercially available from Hodgdon Powder Company, Inc. (Shawnee Mission, Kans.). For example, the single base propellant may include between about 80 wt % and about 100 wt % nitrocellulose, between about 1 wt % and about 2 wt % diphenylamine, between about 4 wt % and about 12 wt % dinitrotoluene, about 0.5 wt % potassium sulfate and less than about 1 wt % graphite.

As a non-limiting example, the propellant composition may be formed by mixing or otherwise combining the stabilized, encapsulated red phosphorous with a double base propellant that includes nitrocellulose plasticized with the energetic plasticizer. The double base propellant may be, for example, a military propellant powder (e.g., M1, M2, M7, M8, M9, WC 844, WC 860 and SMP 842). The double base propellant may include, for example, between about 10 wt % and about 90 wt % of the nitrocellulose and between about 10 wt % and about 90 wt % of the energetic plasticizer, and more particularly, between about 40 wt % and about 70 wt % of the nitrocellulose and between about 30 wt % and about 60 wt % of the energetic plasticizer.

For example, the double base propellant may be BALL POWDER® propellant, which is commercially available from St. Marks Powder, Inc. (St. Marks, Fla.), and which includes between about 0 wt % and about 42 wt % of nitroglycerin, between about 0 wt % to about 10 wt % of dibutyl phthalate, between about 0 wt % and about 10 wt % of polyester adipate, between about 0 wt % and about 10 wt % of ethyl centralite, between about 0 wt % and about 5 wt % of rosin, between about 0 wt % and about 2 wt % of ethyl acetate, between about 0.3 wt % and about 1.5 wt % of diphenylamine, between about 0 wt % and about 1.5 wt % of N-nitrosodiphenylamine, between about 0 wt % and about 1.5 wt % of potassium nitrate, between about 0 wt % and about 3 wt % of potassium sulfate, between about 0 wt % and about 1.5 wt % of tin dioxide, between about 0.02 wt % and about 1 wt % graphite, between about 0 wt % and about 1 wt % calcium carbonate and the remainder to 100 wt % of nitrocellulose.

As another non-limiting example, the double base propellant may be RELOADER® 50 smokeless powder or RELOADER® 15 smokeless powder, each of which is commercially available from Alliant Powder, Inc. (Radford, Va.). The RELOADER® 50 smokeless powder includes nitroglycerin, nitrocellulose and ARKARDIT II stabilizer (i.e., 3-methyl-1,1-diphenylurea commercially available from Synthesia, a.s. (Czech Republic). The RELOADER® 15 smokeless powder includes nitroglycerine, nitrocellulose, diphenylamine, diisoamyl phthalate and ethyl centralite.

By way of example and not limitation, the propellant composition may include between about 0.1 wt % and about 5 wt % of the stabilized, encapsulated red phosphorous (e.g., Red Phosphorus HB 801 (TP)) and between about 99.5 wt % and about 95 wt % of the double base propellant (e.g., BALL POWDER® propellant).

As another non-limiting example, the propellant composition may be formed by combining the stabilized, encapsulated red phosphorous with a multi base propellant that includes nitrocellulose plasticized with at least one energetic plasticizer, such as nitroglycerine, in addition to an energetic fuel. The energetic fuel may include at least one of nitroguanidine and a nitramine (e.g., 4,10-dinitro-2,6,8,12-tetraoxa-4,10-diazatetracyclo-[$5.5.5.0.0^{5,9}0^{3,11}$]-dodecane (TEX), 1,3,5-trinitro-1,3,5-triaza-cyclohexane (RDX), 1,3,5,7-tetranitro-1,3,5,7-tetraaza-cycloocatane (HMX), 2,4,6,8,10,12-hexanitro-2,4,6,8,10,12-hexaazatetracyclo[$5.5.0.0^{5,9}0^{3,11}$]dodecane (CL-20), 3-nitro-1,2,4-triazol-5-one (NTO), 1,3,5-triamino-2,4,6-trinitrobenzene (TATB), 1,1-diamino-2,2-dinitro ethane (DADNE), ammonium dinitramide (AND) and 1,3,3-trinitroazetidine (TNAZ)). The energetic fuel may be present in the propellant composition in an amount of between about 10 wt % of the total weight of the propellant composition and about 60 wt % of the total weight of the propellant composition.

As another non-limiting example, the propellant composition may be formed by combining the stabilized, encapsulated red phosphorous with a composite-modified multi base propellant, which includes nitrocellulose as a binder to immobilize oxidizer particles (e.g., ammonium perchlorate), inorganic fuel (e.g., aluminum) particles or binders and plasticizers. Such binders and plasticizers may include at least one of hydroxyl-terminated polybutadiene (HTPB); carboxy-terminated polybutadiene (CTB); glycidyl azide polymer (GAP); glycidyl azide polymer-based binders; oxetane polymers (e.g., 3-nitratomethyl-3-methyl oxetane (NMMO), 3,3-bis (azidomethyl)oxetane (BAMO) and 3-azidomethyl-3-methyl oxetane (AMMO)); and oxirane polymers (e.g., polyglycidyl nitrate (PGN), polyglycidyl nitrate-based polymers, polycaprolactone polymer (PCP), polybutadiene-acrylonitrile-acrylic acid terpolymer (PBAN), polyethylene glycol (PEG), polyethylene glycol-based polymers and diethyleneglycol triethyleneglycol nitraminodiacetic acid terpolymer (9DT-NIDA)).

The propellant composition may be prepared using conventional techniques, which are not described in detail herein. For example, double base and multi base propellants may be formed from nitrocellulose using conventional solventless processes or cast molding processes. Pelletized nitrocellulose (also referred to as plastisol nitrocellulose), which is available from various sources, including the U.S. Department of the Navy, may be used to form the double base and multi base propellants. Pelletized nitrocellulose includes nitrocellulose configured as pellets, as well as nitrocellulose having other configurations, including but not limited to, granular and/or particle-like (e.g., spherical) configurations. The pellets of nitrocellulose may have average diameters of between about 1 μm and about 50 μm, more particularly, between about 1 μm and about 20 μm.

The single base propellants may be formed using conventional slurry mixing techniques in which the nitrocellulose and is combined with the other ingredients.

In some embodiments, such double base and multi base propellants may be formed using a conventional slurry mixing technique in which nitrocellulose is processed by forming a slurry and the slurry is then poured, in an uncured state, into casting molds or rocket motors in a casting step. The slurry may be prepared by dispersing pelletized nitrocellulose having an average diameter of between about 1 μm and about 20 μm in a diluent, such as heptane. The energetic plasticizer (e.g., nitroglycerine) may then be added to the slurry. Optional processing agents, such as the inert liquid, the solvent, the stabilizer and the surfactant, may be added to the slurry at this stage. After removing a portion of the heptane, mixing is performed under vacuum conditions to remove additional heptane from the slurry. Optionally, the stabilized, encapsulated red phosphorus may then be added to and mixed into the slurry at this stage. Optional additives, such as the carbon compound, the oxidizer, the flash suppressor and the inorganic fuel, may also be mixed with the slurry at this stage. As a non-limiting example, after thoroughly mixing the propellant composition, a suitable cross-linker (e.g., a diisocyanate) may be added and the propellant composition may be cast and cured. As another non-limiting example, the stabilized, encapsulated red phosphorus may optionally be added to the slurry during or after addition of the cross-linker. The propellant composition may be combined to form a mixture of the stabilized, encapsulated red phosphorus and the double or multi base propellant or until the ingredients are homogeneous. For example, the stabilized, encapsulated red phosphorus may be homogeneously dispersed in the double or multi base propellant. As a non-limiting example, the propellant composition may be cast into the desired shapes, or a monolithic block of the cast propellant may be comminuted to form pieces of the desired size.

In other embodiments, the propellant composition may be formed by mixing a single, double or multi base propellant or the composite-modified multi base propellant with the desired amount of the stabilized, encapsulated red phosphorus. The mixing may be performed until a propellant composition including a combination or mixture of the stabilized, encapsulated red phosphorus and the single, double or multi base propellant or composite-modified multi base propellant with the desired amount of stabilized, encapsulated red phosphorus is formed. For example, the stabilized, encapsulated red phosphorus may be homogeneously dispersed in the single, double or multi base propellant or composite-modified multi base propellant.

Once produced, the propellant composition may be loaded into a cartridge for used in various types of ordnance, such as small arms ammunition, grenade, mortar fuse, or detcord initiator. As non-limiting examples, the propellant composition is used in a centerfire gun cartridge, a rimfire gun cartridge, or a shot shell. The propellant composition may be loaded into the cartridge using conventional techniques, such as those used in loading conventional double base propellant compositions, which are not described in detail herein.

For example, the cartridge may be a conventional military cartridge for use with a rifle, such as an M14, an M16 or an AK-47 rifle. As shown in FIG. 1, such a cartridge 100 may include a projectile 102 at least partially disposed within a casing 104 having the propellant composition 106 disposed therein. The projectile 102 may include a penetrator 108, a metal jacket 110 and a metal slug 112. The propellant composition 106 may be disposed within the casing 104 proximate a primer 114. Suitable materials for the penetrator 108, the metal jacket 110, the metal slug 112 and the casing 104 are known in the art and are, thus, not described in detail herein. The propellant composition 106 may include at least one energetic binder and stabilized, encapsulated red phosphorus, as described above. The primer 114 may be a conventional primer composition, examples of which are known in the art and, thus, are not described in detail herein. As a non-limiting example, the primer 114 may include a composition that includes a stabilized, encapsulated red phosphorus, such as a composition including a stabilized, encapsulated red phosphorus, at least one oxidizer, at least one secondary explosive composition, at least one light metal, and at least one acid resistant binder, such as that disclosed in U.S. Pat. No. 7,857,921 to Busky et al.

The propellant composition 106 may be substantially evenly distributed within the casing 104 of the cartridge 100. The propellant composition 106 may be positioned in an aperture within the casing 104, as shown in FIG. 1. The primer 114 may be positioned substantially adjacent to the propellant composition 106 in the cartridge 100. When ignited or combusted, the propellant composition 106 may propel the projectile 102 from the barrel of the firearm or larger caliber ordnance (such as, without limitation, handgun, rifle, automatic rifle, machine gun, mortar, howitzer, automatic cannon, etc.) in which the cartridge 100 is disposed.

The following examples serve to explain embodiments of the propellant composition in more detail. These examples are not to be construed as being exhaustive or exclusive as to the scope of this disclosure.

EXAMPLES

Example 1

Preparation of Propellant Composition

A propellant composition was prepared by mixing stabilized, encapsulated red phosphorus with a double base propellant (BALL POWDER® propellant) including nitrocellulose plasticized with nitroglycerine. The components of the double base propellant (BALL POWDER® propellant) are shown in Table 1.

TABLE 1

Components of Double Base Propellant

| Component | Amount (wt %) |
|---|---|
| Nitroglycerine | 0-42 |
| Dibutyl phthalate | 0-10 |
| Polyester adipate | 0-10 |
| 1,3-diethyl-1,3-diphenylurea | 0-10 |
| Rosin | 0-5 |
| Ethyl acetate | 0-2 |
| Diphenylamine | 0.3-1.5 |
| N-nitrosodiphenylamine | 0-1.5 |
| Potassium nitrate | 0-1.5 |
| Potassium sulfate | 0-1.5 |
| Tin oxide | 0-1.5 |
| Graphite | 0.02-1 |
| Calcium carbonate | 0-1 |
| Nitrocellulose | Remainder to 100 |

The propellant composition was formed to include about 99 wt % of the double base propellant and about 1 wt % of the stabilized, encapsulated red phosphorus. The propellant composition was mixed by conventional techniques. The propellant composition is referred to herein as "composition A."

Example 2

Performance of the Propellant Composition

Test articles were prepared by loading each of the propellant composition of Example 1 (composition A) and the double base propellant (BALL POWDER® propellant) into conventional cartridges with a primer, as that shown in FIG. 1. The primer used to ignite the propellant composition was either a lead-based primer or primer including stabilized, encapsulated red phosphorus, at least one oxidizer, at least one secondary explosive composition, at least one light metal, and at least one acid resistant binder, such as that disclosed in U.S. Pat. No. 7,857,921 to Busky et al. More specifically, the primer included 64.8 wt % potassium nitrate, 25 wt % stabilized, encapsulated red phosphorus, 5 wt % pentaerythritol tetranitrate (PETN), 5 wt % aluminum and 0.25 wt % gum tragacanath.

In the figures, the lead-based primer is referred to as "LB primer," the stabilized, encapsulated red phosphorous-based primer is referred to as the "ERP primer," and the double base propellant (BALL POWDER® propellant) is referred to as "DBP." Electronic pressure velocity and action time (EPVAT) testing was performed for approximately 27 grain charge weight to determine the ballistic properties of composition A and the double base propellant in combination with either the lead-based primer or the stabilized, encapsulated red phosphorous-based primer. The ballistic properties were then compared to determine the effects of using the stabilized, encapsulated red phosphorus in the double based propellant composition and in the primer. The ballistic properties were measured at a mid-case position, a case-mouth position and a port position.

Figure 2A:
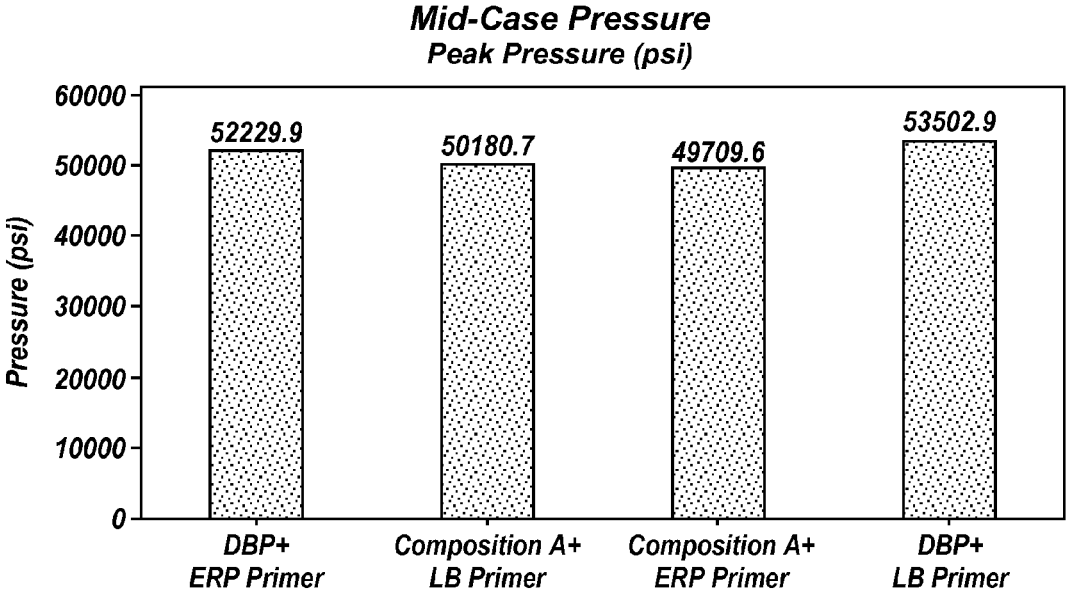
FIGS. 2A through 4D are bar graphs showing a comparison of ballistic properties determined for a conventional propellant composition and an embodiment of a propellant composition of the present disclosure.

FIGS. 2A through 2D are bar graphs showing a comparison of the ballistic properties of propellants measured at the mid-case position. Test articles including Composition A and the double base propellant were each tested in combination with either the lead-based primer or the stabilized, encapsulated red phosphorous-based primer. As shown in FIG. 2A, composition A exhibited a reduced peak pressure in comparison to the conventional double base propellant regardless of the type of primer used. Thus, the test article including composition A exhibited a reduced peak pressure in comparison to the test article including stabilized, encapsulated red phosphorus-based primer with the double base propellant (BALL POWDER® propellant). It was determined that the difference in means in the peak pressure between the test articles including composition A with the lead-based primer and the test articles including composition A with the stabilized, encapsulated red phosphorus-based primer was not statistically significant, suggesting that reduction in the peak pressure may be a function of an amount of stabilized, encapsulated red phosphorus added to the double base propellant.

Figure 2B:
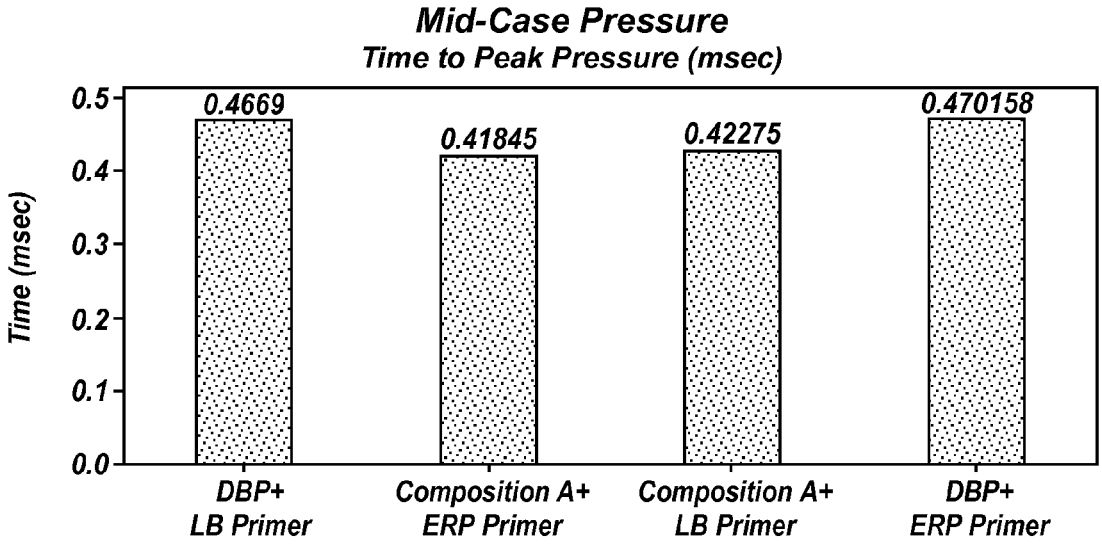

Referring to FIG. 2B, the test article including composition A exhibited a reduced time to peak pressure (msec) in comparison to the double base propellant. Thus, addition of the stabilized, encapsulated red phosphorus to the double base propellant (composition A) provided a significantly change in the time to peak pressure. The difference between times to peak pressure for the mid-case for the different primers was not significant, suggesting that the test article including composition A provides an increase in the burning rate, without increasing the peak pressure (FIG. 2A).

Figure 2C:
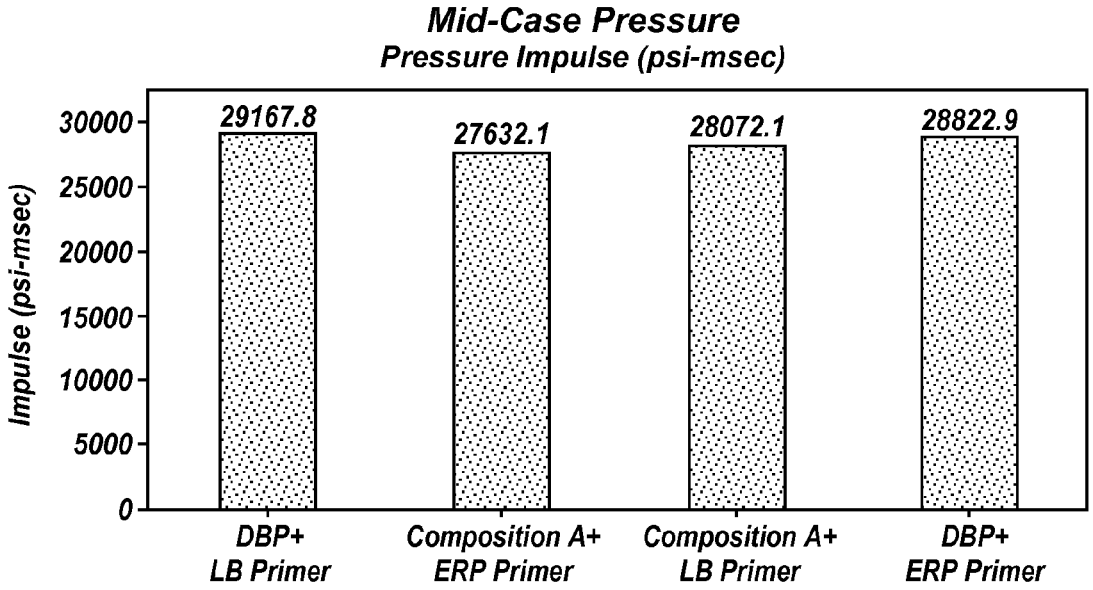

As shown in FIG. 2C, the test article including composition A exhibited an increased pressure impulse (psi/msec) in comparison to the double base propellant. The use of the stabilized, encapsulated red phosphorus-based primer provided a significant reduction in pressure impulse. However, the greatest reduction in pressure impulse was provided by the test article including composition A. The combination of composition A with the stabilized, encapsulated phosphorus based-primer in the test article including provided a substantially lower impulse pressure than did the test article including the combination of composition A with the lead-based primer.

Figure 2D:
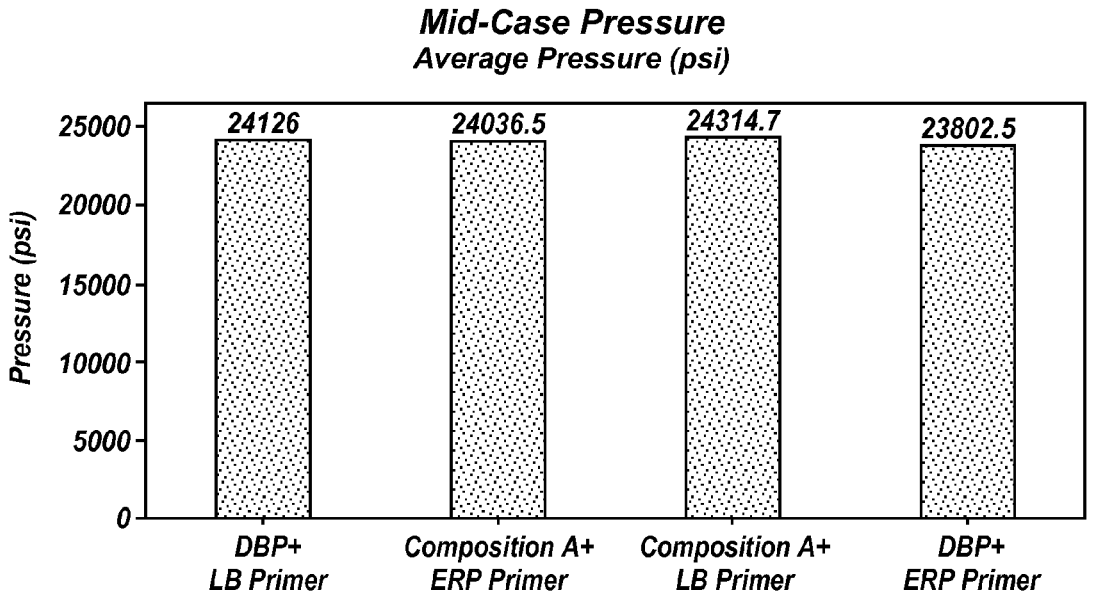

Referring to FIG. 2D, the stabilized, encapsulated red phosphorus-based primer provided a substantial reduction in the average pressure when used in the test articles including both the conventional double based primer and composition A. However, the test article including composition A did not provide a substantial reduction in the average pressure in comparison to the conventional double base propellant when ignited with either the stabilized, encapsulated red phosphorus-based primer or the lead-based primer. The average pressure provided by either propellant when ignited by the stabilized, encapsulated red phosphorus-based primer alone was not significantly different from the average pressures with the ERP in the propellant. This combined with the reduced peak pressure suggests that the test article including composition A provides a substantial increase in uniformity of the burn rate.

Figure 2E:
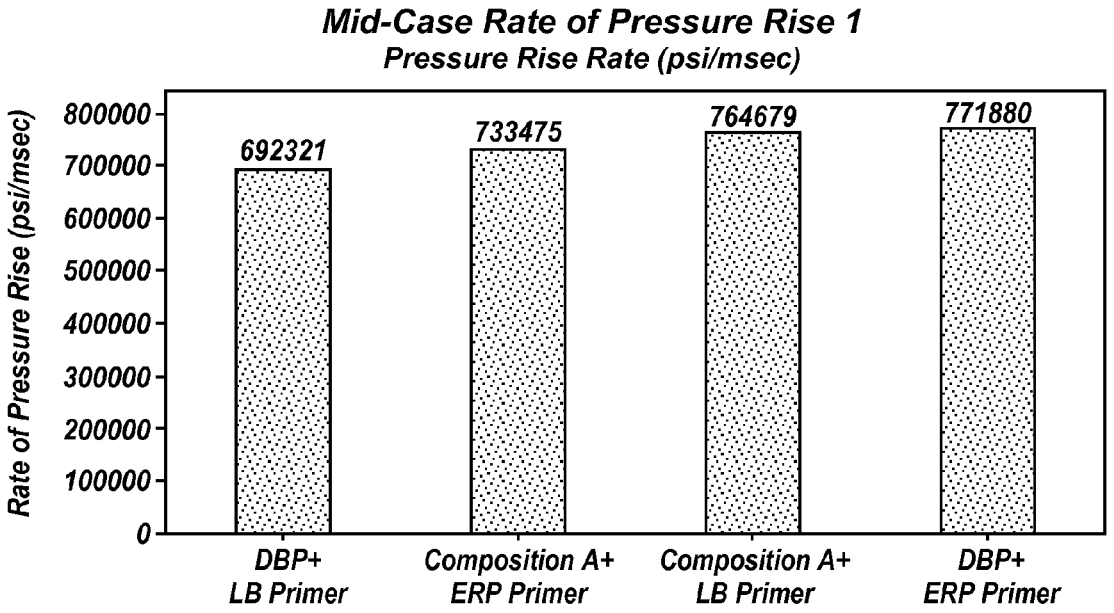
Figure 2F:
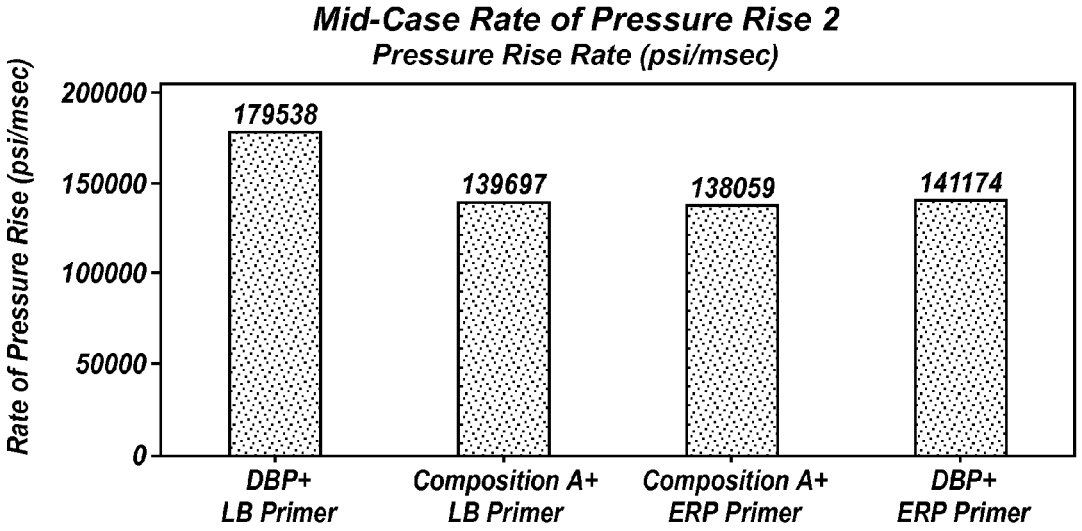

FIGS. 2E and 2F show an estimated pressure rise rate in two stages: 1) a first stage measuring the psi/msec to 25% of peak (FIG. 2E); and 2) a second stage measuring the psi/msec from 25% to 75% of the peak (FIG. 2F).

As shown in FIG. 2E, for the first stage, the test articles including composition A as the propellant and the stabilized, encapsulated red phosphorus-based primer appeared to exhibit increased pressure rise rates in comparison to the test articles without either the stabilized, encapsulated red phosphorus-based primer or composition A. However, due to high deviations, only the stabilized, encapsulated red phosphorus-based primer appeared to provide a significantly increased pressure rise rate. While not wishing to be bound by any particular theory, it is believed that the lack of significance of the increased in pressure rise rate exhibited by the test articles including composition A is due to a large variation in the readings.

As shown in FIG. 2F, for the second stage, the test articles including composition A as well as test articles including the stabilized, encapsulated red phosphorus-based primer exhibited a substantially reduced pressure rise rate in comparison to the article including the double base propellant and the lead-based primer. The difference between the pressure rise rates for the first and second stages suggests that the stabilized, encapsulated red phosphorus has a moderating influence on the rate of pressure generation as a propellant burns.

As shown in FIGS. 2A through 2F, test articles including composition A exhibited a reduced peak pressure, time to peak pressure and pressure impulse compared to test articles including the double base propellant and the lead-based primer, but the test article including composition A did not exhibit a reduced average pressure compared to the test articles including the double base propellant and the lead-based primer. The stabilized, encapsulated red phosphorus-based primer alone did not have the same significant influence on time to peak pressure as composition A, but did on peak pressure and pressure impulse. The test article including composition A appears to have an increased rate of pressurization during the first 25% of rise to the peak pressure. However, the rate of pressurization appeared to slow compared to the double base propellant with the lead-based primer between 25% and 75% of the peak mid-case pressure. While not wishing to be bound by any particular theory, it is believed that the effects of the stabilized, encapsulated red phosphorus on the ballistic properties of the double base propellant composition may be mass dependent, with lower mass providing a higher burn rate at or about the time of ignition.

FIGS. 3A through 3D are bar graphs showing a comparison of the ballistic properties of propellants measured at the case-mouth position. Test articles including Composition A and the double base propellant were each tested in combination with either the lead-based primer or the stabilized, encapsulated red phosphorous-based primer.

Figure 3A:
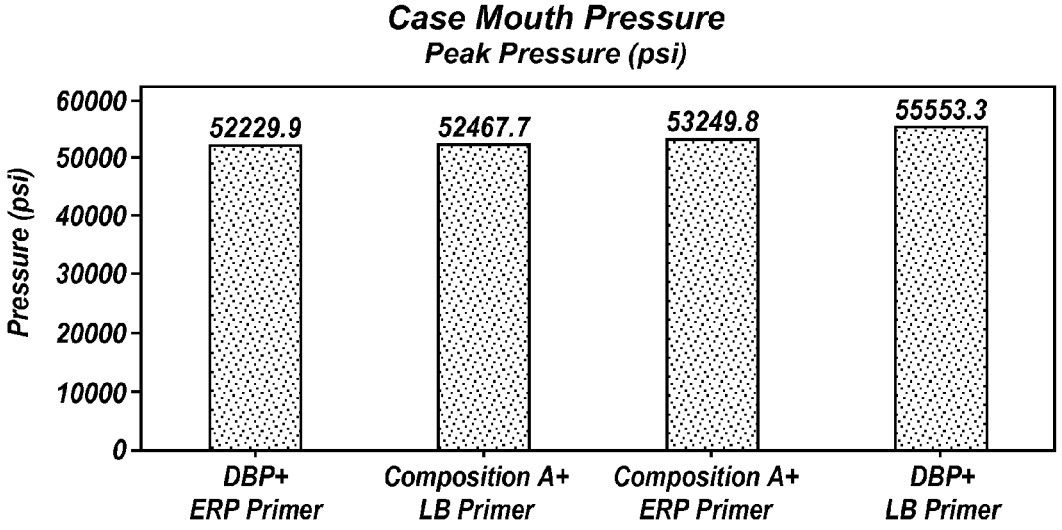

As shown in FIG. 3A, the test article including stabilized, encapsulated red phosphorus-based primer and composition A provided a statistically significant reduction (between about 2,000 psi and about 3,000 psi) in the peak pressure in comparison to the test article including lead-based primer in combination with the conventional double base primer.

Figure 3B:
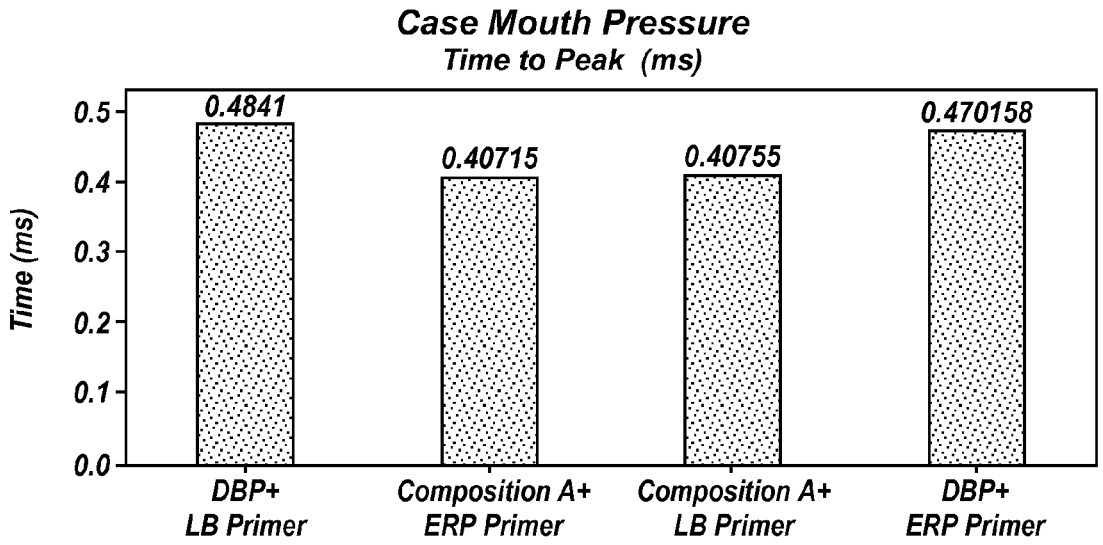

As shown in FIG. 3B, each of the test article that included the stabilized, encapsulated red phosphorus (i.e., composition A and/or the stabilized, encapsulated red phosphorus-based primer) reached peak pressure faster than the test articles without the stabilized, encapsulated red phosphorus (i.e., the double base propellant with the lead-based primer). The test article including composition A exhibited an increased time to peak pressure in comparison to the double based propellant in combination with the stabilized, encapsulated red phosphorus-based primer. The stabilized, encapsulated red phosphorus-based primer provided an increased time to peak in comparison to the conventional lead-based primer, but exhibited a reduced time to peak in comparison to composition A regardless of which primer was used. These results suggest that addition of the stabilized, encapsulated red phosphorus to a conventional double base propellant increases the rate of reaction without increasing the peak pressure.

Figure 3C:
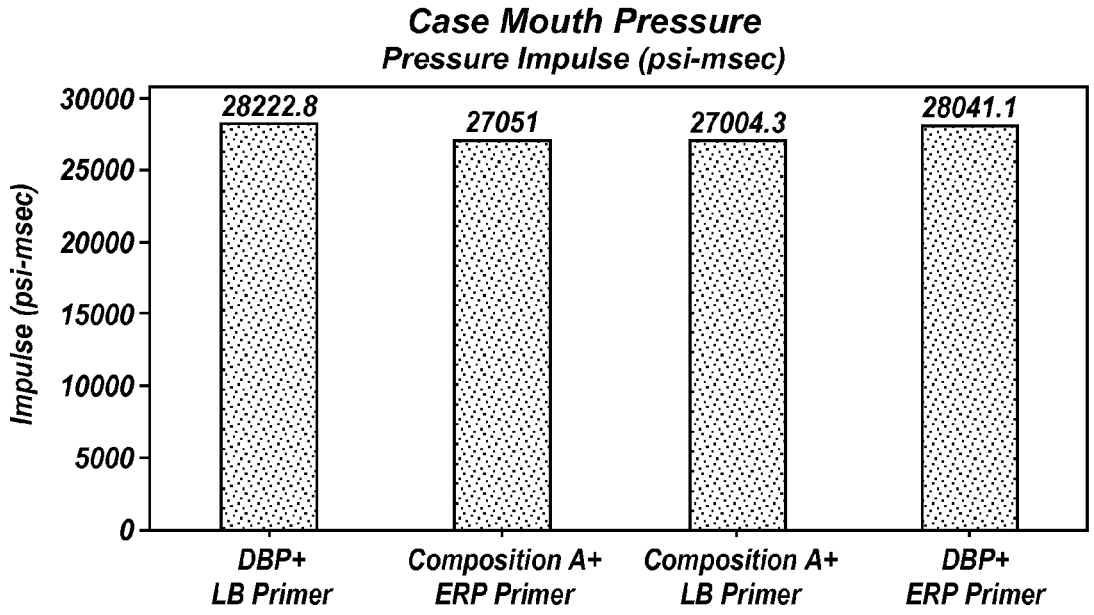

As shown in FIG. 3C, the test articles including stabilized, encapsulated red phosphorus (i.e., composition A and/or the stabilized, encapsulated red phosphorus-based primer) exhibited reduced pressure impulse. The pressure impulse exhibited by the test articles including composition A was increased in comparison to the test article including the conventional double base propellant and the stabilized, encapsulated red phosphorus-based primer. The difference in the pressure impulse between the two test articles including composition A was not significant. Thus, addition of the stabilized, encapsulated red phosphorus to the conventional double base propellant composition provided a significant increase in the pressure impulse.

Figure 3D:
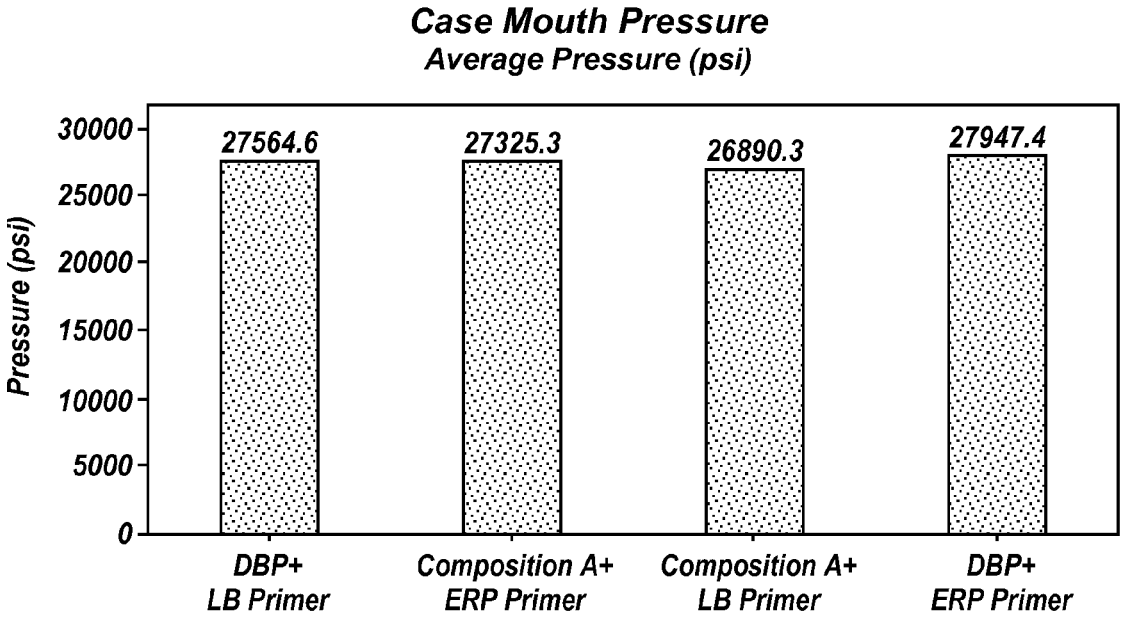

As shown in FIG. 3D, the average pressure exhibited by the test article including the lead-based primer in combination with composition A was significantly reduced in comparison to the two test articles including the stabilized, encapsulated red phosphorous-based primer. The test article including the stabilized, encapsulated red phosphorus in both the primer and the propellant (i.e., the stabilized, encapsulated red phosphorus-based primer and composition A) exhibited a significantly reduced average pressure in comparison to the test article including the stabilized, encapsulated red phosphorus in the primer only (i.e., the stabilized, encapsulated red phosphorus-based primer and the conventional double base propellant). These data suggest a broadening of pressure versus time curve (p-t curve) since the peak pressure and time to peak is lower for the test articles including composition A.

The ballistic properties measured at the case mouth position demonstrate that the test article including composition A provides a significant reduction in the peak pressure, the time to peak pressure and the pressure impulse without a significant reduction in the average pressure. The previously discussed data show that the effects of adding the stabilized, encapsulated red phosphorus to the double base propellant results in a greater change in the ballistic properties than does adding the stabilized, encapsulated red phosphorus to the primer alone. While not wishing to be bound by any particular theory, it is believed that the magnitude of the difference between the ballistic properties of composition A and the stabilized, encapsulated red phosphorus-based primer alone suggests that changes in the ballistic properties resulting from addition of the stabilized, encapsulated red phosphorus may be mass dependent.

FIGS. 4A through 4D are bar graphs showing a comparison of the ballistic properties of the test articles including propellants measured at the case-mouth position. Test articles including composition A and the double base propellant were each tested in combination with either the lead-based primer or the stabilized, encapsulated red phosphorous-based primer.

Figure 4A:
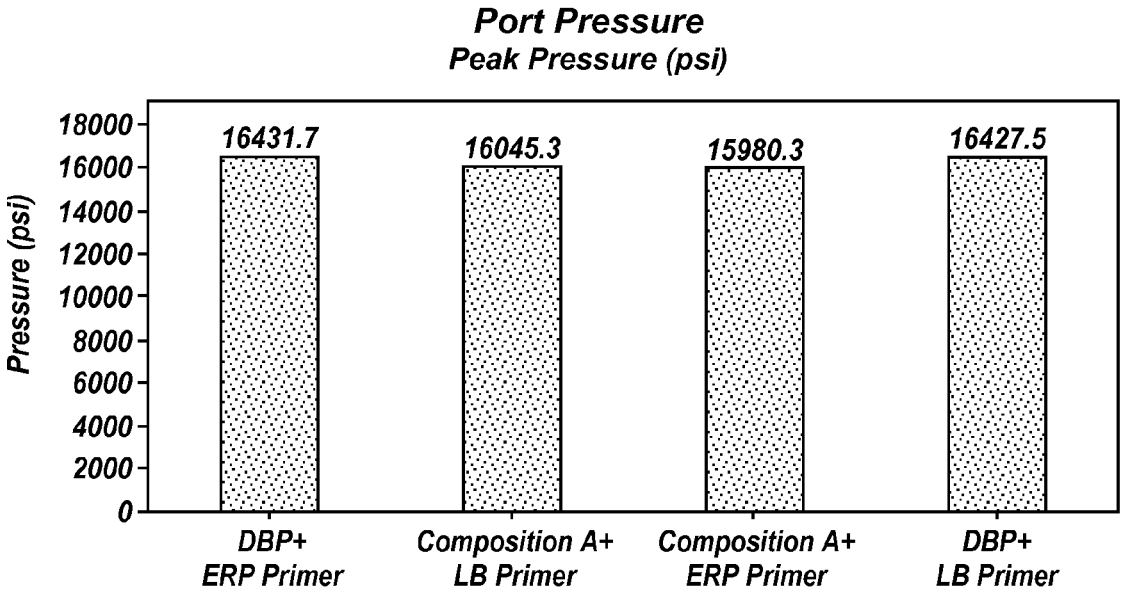

As shown in FIG. 4A, the test article including composition A exhibited a significantly reduced peak pressure in comparison to the other test articles. Using the stabilized, encapsulated red phosphorous-based primer in combination with the double base propellant did not significantly reduce the peak pressure.

Figure 4B:
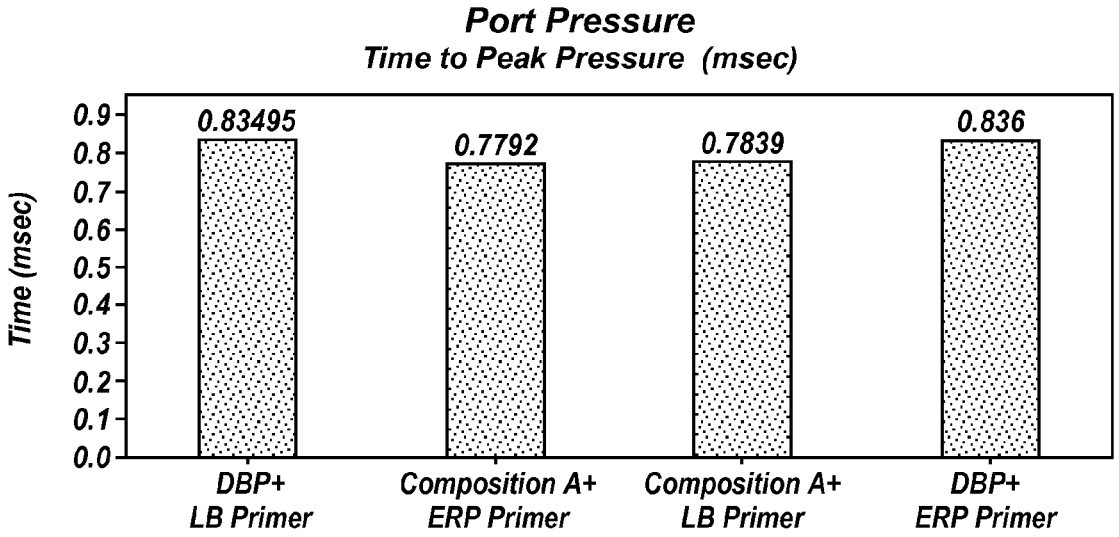

As shown in FIG. 4B, the test article including composition A exhibited a significantly reduced time to peak pressure in comparison to the other test articles. Using the stabilized, encapsulated red phosphorous-based primer in combination with the double base propellant did not significantly reduce the time to peak pressure.

Figure 4C:
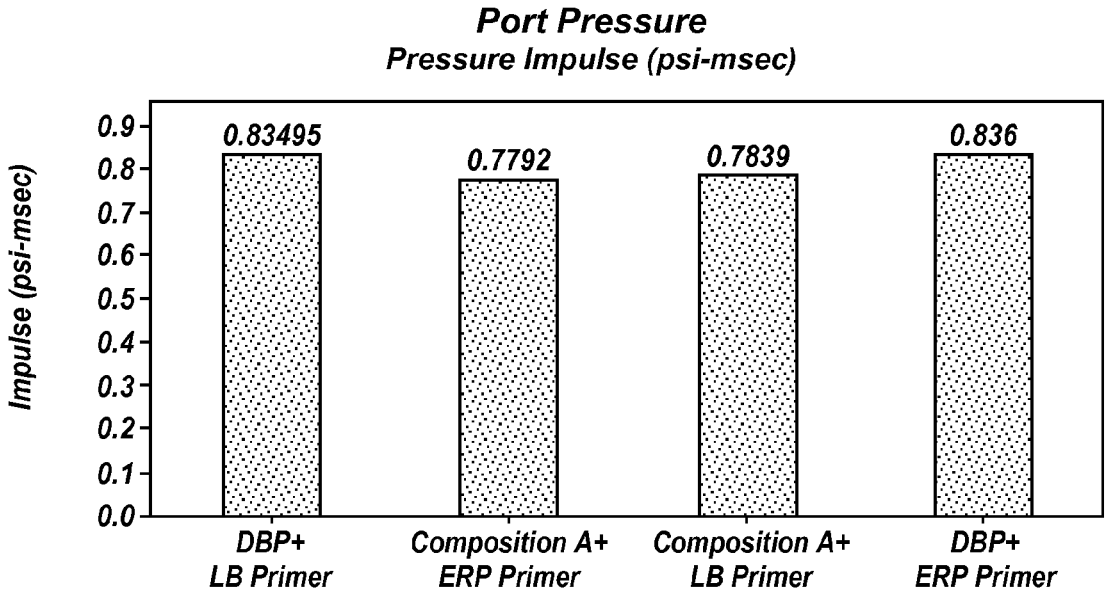

As shown in FIG. 4C, the test article including composition A exhibited a significantly reduced pressure impulse at the port in comparison to the other test articles. Using the stabilized, encapsulated red phosphorous-based primer in combination with the double base propellant did not significantly reduce the pressure impulse in comparison to using the lead-based primer in combination with the conventional double base propellant.

Figure 4D:
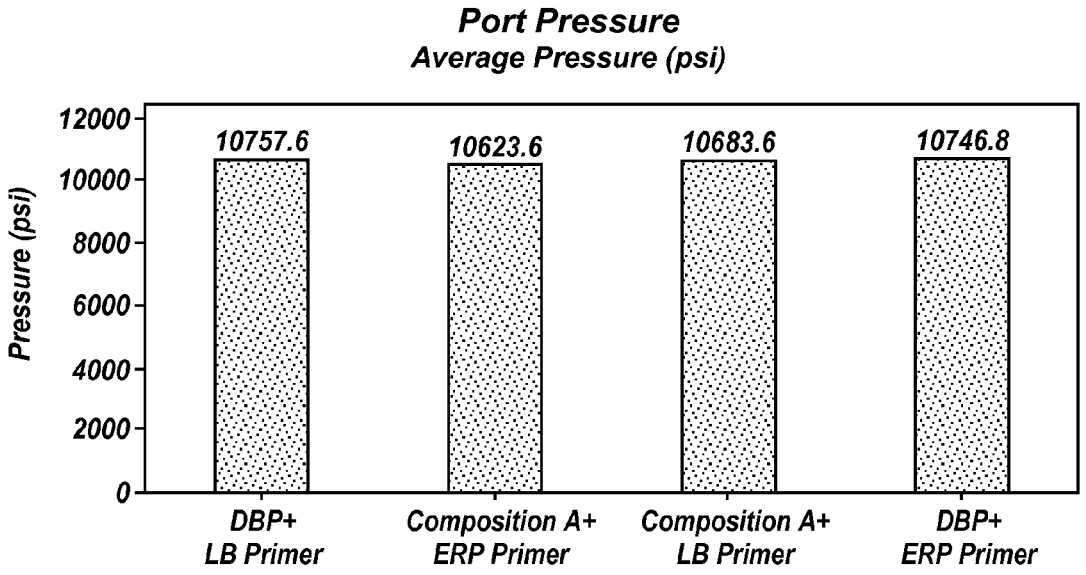

As shown in FIG. 4D, the test article including composition A exhibited a significantly reduced average pressure in comparison to the other test articles. Using the stabilized, encapsulated red phosphorous-based primer in combination with the double base propellant did not significantly change the average pressure in comparison to using the lead-based primer in combination with the double base propellant.

Thus, as with the mid-case and case mouth pressures, the test articles including composition A provided a significant reduction in the peak pressure, the time to peak pressure and the pressure impulse in comparison to the test articles including the double based propellant. Test articles including composition A additionally provided a reduction in average port pressure in comparison to the test articles including the double based propellant. These data suggest that the reactions that reduce the pressure are still occurring as the projectile passes the port.

Example 3

Velocity of the Propellant Composition

Figure 5:
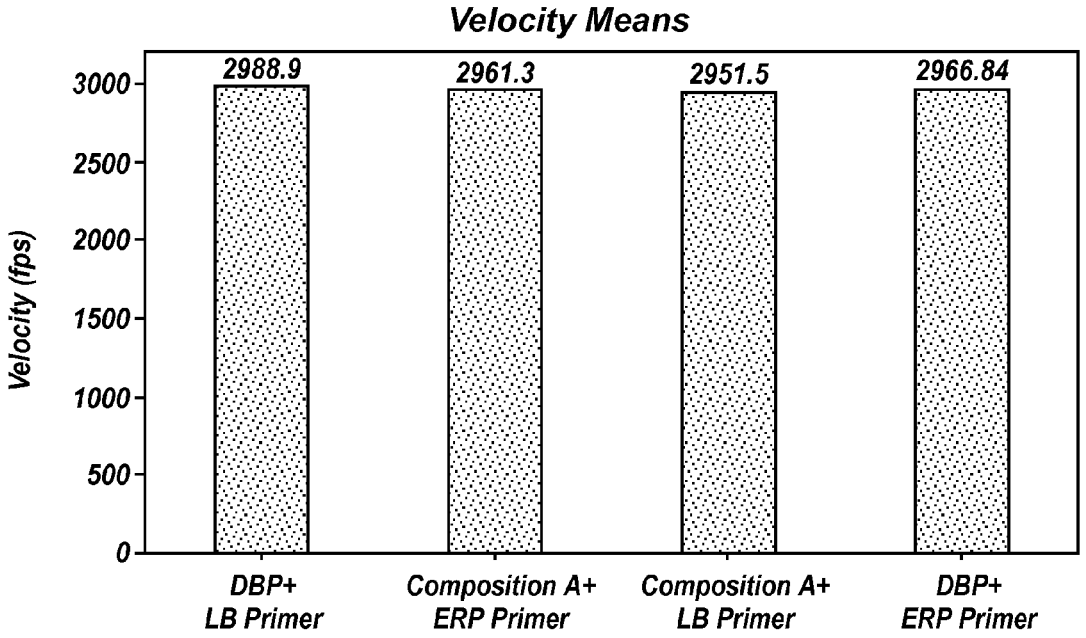
FIG. 5 is a bar graph showing a comparison of velocity determined for the conventional propellant composition and an embodiment of the propellant composition of the present disclosure.

A mean velocity was determined for test articles including composition A and the double base propellant in combination with one of the lead-based primer and the stabilized, red phosphorus primer. As shown in FIG. 5, the mean velocity provided by the test article including composition A was significantly reduced in comparison to the mean velocity provided by the double base propellant regardless of the primer. The test article including the combination of the lead-based primer with composition A exhibited the lowest velocity. As the specification for velocity has both a minimum and a maximum, it is believed that composition A enables the velocity to be tailored by controlling the amount of stabilized, encapsulated red phosphorus added to a conventional propellant, such as a double base propellant. While not wishing to be bound by any particular theory, increased reaction products from composition A may result in an increase in gas loss during burning compared to gas loss from the double base propellant.

Addition of the stabilized, encapsulated red phosphorus to the double base propellant significantly modified the ballistic properties measured. More specifically, the peak pressure, the time to peak pressure and the pressure impulse were all reduced without significantly reducing the average pressure. While not wishing to be bound by any particular theory, it believed that this suggests that the stabilized, encapsulated red phosphorus may be used to reduce strain on an ordnance device or weapon system by combustion of the propellant. Addition of the stabilized, encapsulated red phosphorus to the double base propellant may also reduce the velocity provided by the propellant.

While the present disclosure is susceptible to various modifications and alternative forms, specific embodiments have been shown by way of example in the drawings and have been described in detail herein. However, the invention is not intended to be limited to the particular forms disclosed. Rather, the invention includes all modifications, equivalents, and alternatives falling within the scope of the present disclosure as defined by the following appended claims and their legal equivalents. For example, elements and features disclosed in relation to one embodiment may be combined with elements and features disclosed in relation to other embodiments of the present invention.

What is claimed is:

1. A propellant composition comprising nitrocellulose, nitroglycerine, dibutyl phthalate, polyester adipate, ethyl centralite, rosin, ethyl acetate, diphenylamine, N-nitrosodiphenylamine, potassium nitrate, potassium sulfate, tin dioxide, graphite, and calcium carbonate.

2. A method of forming a propellant composition, comprising:

combining a stabilized, encapsulated red phosphorus with nitrocellulose, an energetic plasticizer, and at least one energetic fuel comprising at least one of nitroguanidine and at least one nitramine, the at least one nitramine comprising at least one of 4,10-dinitro-2,6,8,12-tetraoxa-4,10-diaza-tetracyclo-[5.5.5.0.0$^{5,9}$0$^{3,11}$]-dodecane (TEX), 1,3,5-trinitro-1,3,5-triaza-cyclohexane (RDX), 1,3,5,7-tetra-nitro-1,3,5,7-tetraaza-cycloocatane (HMX), 2,4,6,8,10,12-hexanitro-2,4,6,8,10,12-hexa-azatetracyclo[5.5.0.0$^{5,9}$0$^{3,11}$]dodecane (CL-20), 3-nitro-1,2,4-triazol-5-one (NTO), 1,3,5-triamino-2,4,6-trinitrobenzene (TATB), 1,1-diamino-2,2-dinitro ethane (DADNE), ammonium dinitramide (AND), and 1,3,3-trinitroazetidine (TNAZ).

3. The method of claim 2, further comprising plasticizing the nitrocellulose with the energetic plasticizer, the energetic plasticizer comprising at least one nitrate ester.

4. The method of claim 2, wherein combining a stabilized, encapsulated red phosphorus with nitrocellulose comprises homogeneously dispersing the stabilized, encapsulated red phosphorus in the nitrocellulose.

5. A propellant composition, comprising:

nitrocellulose;

an energetic plasticizer;

at least one energetic fuel comprising at least one of nitroguanidine and at least one nitramine, wherein the at least one nitramine comprises at least one of 4,10-dinitro-2,6,8,12-tetraoxa-4,10-diaza-tetracyclo-[5.5.5.0.0$^{5,9}$ 0$^{3,11}$]-dodecane (TEX), 1,3,5-trinitro-1,3,5-triaza-cyclohexane (RDX), 1,3,5,7-tetra-nitro-1,3,5,7-tetraaza-cycloocatane (HMX), 2,4,6,8,10,12-hexanitro-2,4,6,8,10,12-hexa-azatetracyclo[5.5.0.0$^{5,9}$ 0$^{3,11}$]dodecane (CL-20), 3-nitro-1,2,4-triazol-5-one (NTO), 1,3,5-triamino-2,4,6-trinitrobenzene (TATB), 1,1-diamino-2,2-dinitro ethane (DADNE), ammonium dinitramide (AND), and 1,3,3-trinitroazetidine (TNAZ); and a stabilized, encapsulated red phosphorus.

6. The propellant composition of claim 5, wherein the energetic plasticizer comprises at least one of nitroglycerine, trinitroglycerine, metriol trinitrate, trimethylolethane trinitrate, diglycol dinitrate, triethylene glycol dinitrate, butanetriol trinitrate, diethyleneglycol dinitrate, propylene glycol dinitrate, ethylene glycol dinitrate, butyl-2-nitratoethyl-nitramine, methyl-2-nitratoethyl-nitramine, and ethyl-2-nitratoethyl-nitramine.

7. The propellant composition of claim 5, wherein the energetic plasticizer comprises nitroglycerine.

8. The propellant composition of claim 5, further comprising at least one of an inert liquid, an oxidizer, a flash suppressor, a metal fuel, a carbon compound, a solvent, a stabilizer, and a surfactant.

9. The propellant composition of claim 5, wherein the propellant composition comprises nitrocellulose, nitroglycerine, the stabilized, encapsulated red phosphorus, and the at least one energetic fuel comprising at least one of nitroguanidine and a nitramine, wherein the nitramine comprises at least one of 4,10-dinitro-2,6,8,12-tetraoxa-4,10-diazatetracyclo-[5.5.5.0.$0^{5,9}0^{3,11}$]-dodecane (TEX), 1,3,5-trinitro-1,3,5-triaza-cyclohexane (RDX), 1,3,5,7-tetra-nitro-1,3,5,7-tetraaza-cycloocatane (HMX), 2,4,6,8,10,12-hexanitro-2,4,6,8,10,12-hexa-azatetracyclo[5.5.0.$0^{5,9}0^{3,11}$]dodecane (CL-20), 3-nitro-1,2,4-triazol-5-one (NTO), 1,3,5-triamino-2,4,6-trinitrobenzene (TATB), 1,1-diamino-2,2-dinitro ethane (DADNE), ammonium dinitramide (AND), and 1,3,3-trinitroazetidine (TNAZ).

10. The propellant composition of claim 5, wherein the at least one energetic fuel comprises between about 10 wt % of a total weight of the propellant composition and about 60 wt % of the total weight of the propellant composition.

11. A propellant composition, comprising:

a propellant comprising an energetic binder and an energetic plasticizer, the energetic binder comprising at least one of cyclodextrin nitrate, polyvinyl nitrate, a dinitropropylacrylate polymer, and a polymeric nitroethylene and the energetic plasticizer comprising at least one of trinitroglycerine, metriol trinitrate, trimethylolethane trinitrate, diglycol dinitrate, triethylene glycol dinitrate, butanetriol trinitrate, diethyleneglycol dinitrate, propylene glycol dinitrate, ethylene glycol dinitrate, butyl-2-nitratoethyl-nitramine, methyl-2-nitratoethyl-nitramine, and ethyl-2-nitratoethyl-nitramine; and a stabilized, encapsulated red phosphorus.

* * * * *

UNITED STATES PATENT AND TRADEMARK OFFICE

CERTIFICATE OF CORRECTION

PATENT NO. : 9,199,887 B2
APPLICATION NO. : 14/166521
DATED : December 1, 2015
INVENTOR(S) : Matthew T. Hafner et al.

It is certified that error appears in the above-identified patent and that said Letters Patent is hereby corrected as shown below:

In the specification:

COLUMN 1, LINE 13, change "12/978,080, Filed December 23, 2010," to --12/978,080, filed December 23, 2010,--

In the claims:

CLAIM 5, COLUMN 16, LINE 41, change "[5.5.5.0.0$^{5,9}$ 0$^{3,11}$]-dodecane (TEX)," to --[5.5.5.0.0$^{5,9}$0$^{3,11}$]-dodecane (TEX),--

Signed and Sealed this
Twenty-sixth Day of April, 2016

Michelle K. Lee

Michelle K. Lee
*Director of the United States Patent and Trademark Office*